United States Patent [19]

Bogner et al.

[11] 4,195,493

[45] Apr. 1, 1980

[54] ANNULAR JEWELRY ARTICLE

[76] Inventors: Max Bogner, 427 Ft. Washington Ave., New York, N.Y. 10033; Larry Grun, 6411 99th St., Rego Park, N.Y. 11374

[21] Appl. No.: 891,191

[22] Filed: Mar. 29, 1978

[51] Int. Cl.[2] ..... A44C 9/00; A44C 27/00

[52] U.S. Cl. ..... 63/15; 29/160.6; 63/26

[58] Field of Search ..... 63/15, 3, 26; 29/160.6

[56] References Cited

U.S. PATENT DOCUMENTS

| | | | |
|---|---|---|---|
| 169,929 | 11/1875 | Thomson | 63/3 |
| 1,695,067 | 12/1928 | Suderov | 29/160.6 |
| 1,794,784 | 3/1931 | Marinelli | 63/15 |
| 2,035,562 | 3/1936 | Minister | 63/15 |
| 2,103,412 | 12/1937 | Gaertner | 63/15 |

*Primary Examiner*—F. Barry Shay

*Attorney, Agent, or Firm*—Charles E. Temko

[57] ABSTRACT

Articles of jewelry, such as rings, bracelets and the like, in which the same are of hollow construction including an imperforate liner normally in contact with the wearer. An outer member in generally surrounding relation with respect to the liner member is provided with a plurality of shaped orifices extending through the plane thereof. Inserts of contrasting color and corresponding shape and positioned within the orifices and soldered to the concealed surface of the liner. Where necessary, end plates overlie the interstice between the liner member and the outer member.

1 Claim, 4 Drawing Figures

ANNULAR JEWELRY ARTICLE

BACKGROUND OF THE INVENTION

In the jewelry manufacturing art, it is known to form objects or precious metal by assembling a plurality of component parts of relatively thin cross-sections, whereby the finished article is hollow and gives the appearance of solid metal. With the ever-increasing cost of precious metals, this type of construction has become increasingly popular.

It is also known to vary the color of gold articles by alloying the gold with other metals. Gold alloyed with copper, for example, acquires the color of copper, although it retains the tarnish resistance of gold. Gold alloyed with nickel acquires a silver color. It is known to use such alloys in the formation of composite articles formed of different colored metals to produce interesting ornamental effects. Because the components of different colors must be formed separately and welded or soldered together, the area in which the welding or soldering occurs must be carefully contained, and subsequently polished in order to assure an attractive completed article. As a result, such articles tend to be quite costly to manufacture.

SUMMARY OF THE INVENTION

Briefly stated, the invention contemplates the provision of a hollow article of jewelry, such as a ring or bracelet, which includes an imperforate liner member and a perforate outer member which forms the outer surface of the finished article. The outer member is provided with through openings of various shapes which expose the inner surface of the lining member. Within the openings and extending into the interstice existing between the liner and outer members, there are positioned solid inserts or pieces of contrasting color which are soldered or otherwise interconnected to the inner surface of the liner member, following which the exposed surfaces of the insert and the outer surface of the outer member are polished flush. Normally, a recessed border is provided which may be filled with a coating of contrasting color.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
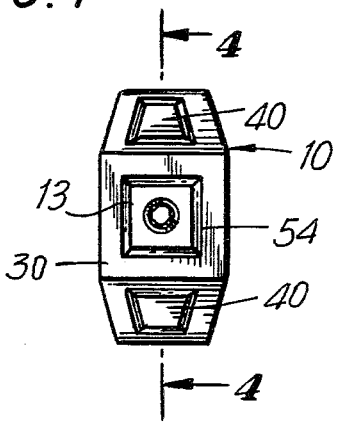
FIG. 1 is a top plan view of an article of jewelry embodying the invention.
Figure 2:
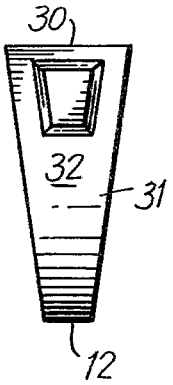
FIG. 2 is a side elevational view thereof.
Figure 3:
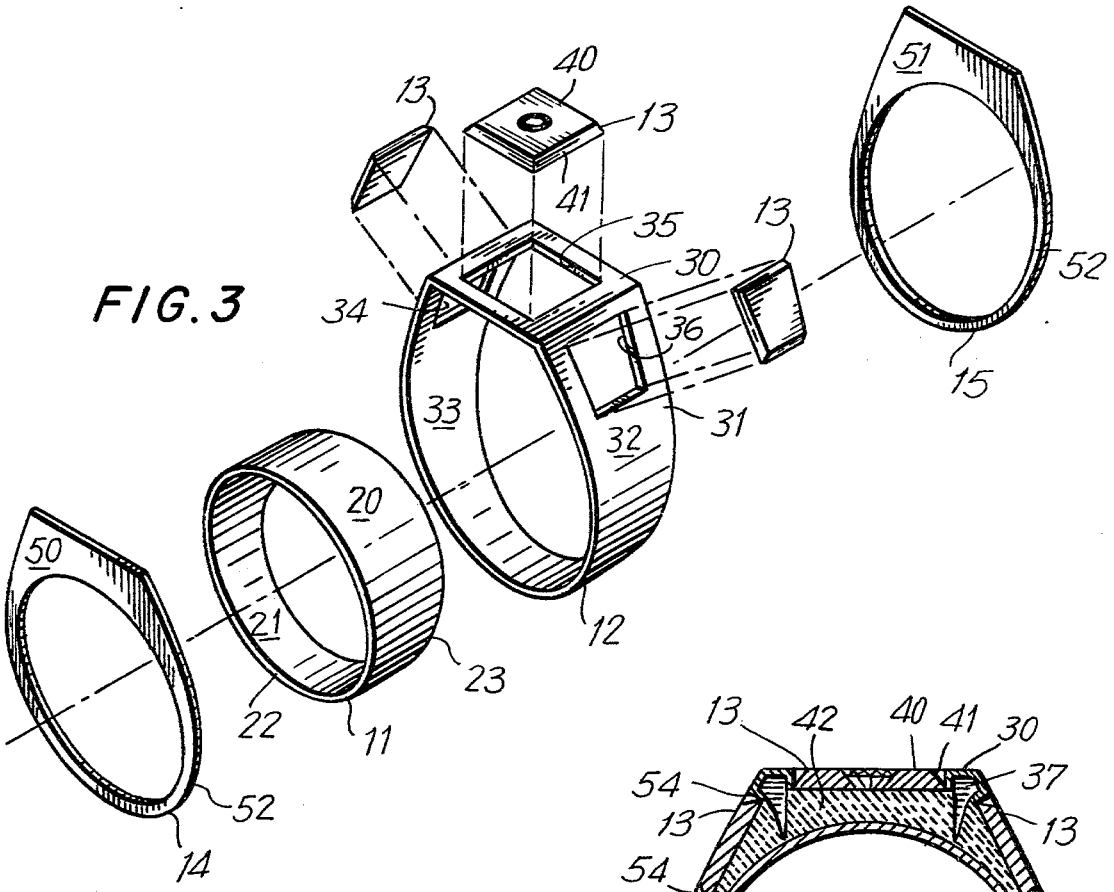
FIG. 3 is an exploded view in perspective of the embodiment.
Figure 4:
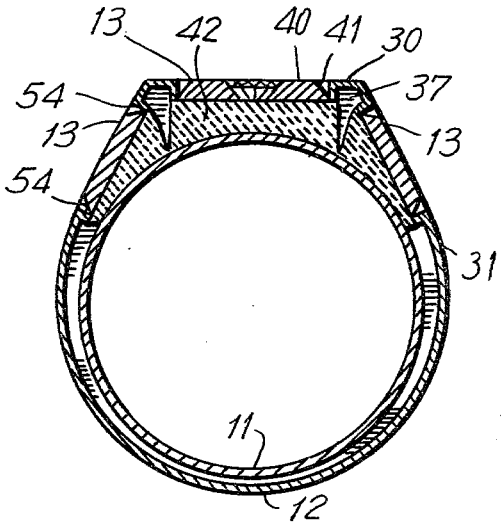
FIG. 4 is a transverse sectional view as seen from the plane 4—4 in FIG. 1.

In accordance with the invention, the device, generally indicated by reference character 10, comprises broadly: an inner liner member 11, an outer configured member 12, a plurality of metallic inserts 13, and orificed end plates 14 and 15.

The inner liner member 11 is in the form of a hollow cylinder, and is bounded by an outer surface 20, an inner surface 21, and end edges 22 and 23.

The outer member 12 is adapted to surround the inner member 11, and includes a top wall 30 and a curvilinear wall 31 which are interconnected to form a continuous outer or exposed surface 32 and an inner or concealed surface 33. A plurality of through openings 34, 35 and 36 extend through the planes of the walls 30 31, and 32 respectively and communicate with the interstice 37.

The metallic inserts 13, depending upon the thickness of the article, may be formed as either stampings or castings of metal preferably differing in color from that of the outer member 12. Each includes an outer surface 40, side surfaces 41, and is secured within the interstice 37 by soldering or welding, as indicated by reference character 42, this operation serving to reinforce the rigidity of the completed article.

The end plates 14 and 15 are similar, and serve to close the interstice 37 at the ends thereof. Each is bounded by an outer surface 50, an inner surface 51 and peripheral edges 52. They are normally soldered or welded to interconnect the members 11 and 12 prior to the positioning of the inserts 13, and thus serve as a means for containing the soldering or welding metal 42.

After assembly, final polishing is applied over the entire article, and particularly to the outer surfaces 30 and 42, so that the exposed surface of the insert may be made flush with that of bordering edge of the opening in the outer member. In order to accentuate the difference in color, it is preferable to make the insert slightly smaller than the opening in which it is positioned, wherein the welding metal will form a recessed border, as indicated by reference character 54. The exposed surfaces of the border may be treated by an oxide serving to give the border a dark color, accentuating the outline thereof.

We wish it to be understood that we do not consider the invention limited to the precise details of structure shown and set forth in this specification, for obvious modifications will occur to those skilled in the art to which the invention pertains.

We claim:

1. An annular article of jewelry comprising an annular imperforate liner member having an exposed surface adapted to contact a wearer and a concealed oppositely disposed surface; an outer annular perforate member supported in surrounding relation relative to said liner member and forming therebetween an annular interstice, said outer member having at least one through opening therein communicating with a portion of said interstice; an insert of configuration at least partially corresponding to said through opening and positioned within said opening; means directly securing said insert in fixed relation relative to said liner member; said liner member and outer member being of different diameters to form said interstice, and a pair of orificed end plates annularly interconnected to the free edges of said liner and outer members to enclose said annular space and form imperforate side faces of said annular article.

* * * * *